US005447378A

United States Patent [19]

Otsuka et al.

[11] Patent Number: 5,447,378

[45] Date of Patent: Sep. 5, 1995

[54] TAPE PRINTING APPARATUS

[75] Inventors: Satomi Otsuka, Konan; Akihiro Sawada, Nagoya; Sachiro Nagase, Nishikasugai, all of Japan

[73] Assignee: Brother Kogyo Kabushiki Kaisha, Nagoya, Japan

[21] Appl. No.: 156,830

[22] Filed: Nov. 24, 1993

[30] Foreign Application Priority Data

Jan. 7, 1993 [JP] Japan ..... 5-001148

[51] Int. Cl.[6] ..... B41J 11/48

[52] U.S. Cl. ..... 400/61; 400/76; 400/615.1

[58] Field of Search ..... 400/61, 76, 88, 120, 400/615.2, 586

[56] References Cited

U.S. PATENT DOCUMENTS

| | | | |
|---|---|---|---|
| 4,736,255 | 4/1988 | Miura et al. | 358/300 |
| 4,921,363 | 5/1990 | Nishihara et al. | 400/120 |
| 5,018,081 | 5/1991 | Yamaguchi et al. | 400/76 |
| 5,207,516 | 5/1993 | Suzuki | 400/120 |
| 5,253,334 | 10/1993 | Kimura et al. | 400/686 |
| 5,302,038 | 4/1994 | Hirono et al. | 400/615.2 |
| 5,314,256 | 5/1994 | Niwa | 400/61 |

FOREIGN PATENT DOCUMENTS

| | | |
|---|---|---|
| 0322918 | 7/1989 | European Pat. Off. . |
| 0497352 | 5/1992 | European Pat. Off. . |
| 0512168 | 11/1992 | European Pat. Off. . |
| 3-217860 | 9/1991 | Japan . |

OTHER PUBLICATIONS

Patent Abstracts of Japan, vol. 16, No. 274 (M-1267); Jun. 19, 1992 & JP-A-04 067 984 (Yakult Honsha Co. Ltd.) Mar. 3, 1992.

Patent Abstracts of Japan, vol. 17, No. 92 (M-1371); Feb. 23, 1993 & JP-A-04 288 257 (Brother Ind. Ltd.) Oct. 13, 1992.

*Primary Examiner*—Ren Yan
*Assistant Examiner*—John S. Hilten
*Attorney, Agent, or Firm*—Oliff & Berridge

[57] ABSTRACT

A tape printing apparatus having a test printing function for printing a predetermined test pattern onto a tape upon operation of an appropriate key includes a printing part, a tape width detector, a memory and a print control unit. The printing part prints the predetermined test pattern. The tape width detector detects the width of the currently loaded tape. The memory stores test pattern data by which to print any one of a plurality of different test patterns depending on the tape width detected by the tape width detector. The print control unit retrieves from the memory the test pattern data corresponding to the detected tape width upon operation of the appropriate key and causes the printing part to print the test pattern onto the tape based on the retrieved test pattern data. Because the tape printing apparatus prints the test pattern according to the width of the currently loaded tape, an operator can determine what printing is available for that particular tape.

21 Claims, 7 Drawing Sheets

TAPE PRINTING APPARATUS

BACKGROUND OF THE INVENTION

1. Field of the Invention

The present invention relates to a tape printing apparatus with a test printing function, the apparatus having a printer that prints predetermined test patterns onto a tape when an appropriate key is operated.

2. Description of the Related Art

Heretofore, word processors and like machines have a test printing function or demonstration printing function designed to print predetermined test patterns upon operation of an appropriate key. The printed test patterns allow the user to know the fonts and ornamented characters that may be printed by the machine.

There also exist tape printing devices such as that disclosed in Japanese Patent Application No. Hei 3-217860. The disclosed tape printing apparatus has a thermal head that prints the characters and other symbols entered from a keyboard onto a tape.

The disclosed tape printing apparatus accommodates any one of five different widths of tapes: 6 mm, 9 mm, 12 mm, 18 mm and 24 mm. The apparatus prints characters and other symbols on tapes of the different widths. In addition, the disclosed apparatus prints fonts of various sizes as well as diversely ornamented characters. However, characters of specific sizes or in particular ornamental styles may not be available for printing on particular tape widths.

As with the word processors, the disclosed tape printing apparatus needs and is provided with the test or demonstration printing function whereby printable character sizes and ornamental styles are verified. The test patterns printed by the test or demonstration printing function include those characters of all sizes and in all ornamental styles that may be printed by the tape printing apparatus.

The above tape printing apparatus is furnished with only one kind of data by which to print the test patterns. The limited amount of the test pattern print data gives rise to one disadvantage of the apparatus. That is, when a wide tape is loaded in the tape printing apparatus, the test patterns are printed thereon without trouble; but when a narrow tape is used for test pattern printing, large-size characters of the printed test patterns can exceed the tape width.

Attempts to print test patterns onto the narrow tape can damage the platen roller of the apparatus. That is, when set to print the test patterns, the apparatus heats up its thermal head while the tape is being pinched between the thermal head and the platen roller made of rubber. With some heating elements of the thermal head coming into direct contact with the platen surface, the rubber platen roller can be burned and damaged.

SUMMARY OF THE INVENTION

It is therefore an object of the invention to overcome the above and other deficiencies and disadvantages of the prior art and to provide a tape printing apparatus capable of printing test patterns regardless of the width of the tape currently loaded, so that the user may verify the characters and their ornamentations available for printing on the currently loaded tape.

In carrying out the invention and according to one aspect thereof, there is provided a tape printing apparatus having a test printing function for printing onto a tape a predetermined test pattern, the tape printing apparatus including: a printer for printing the predetermined test pattern; a tape width detecting device for detecting the width of the currently loaded tape; a storage device for storing test pattern data by which to print any one of a plurality of different test patterns depending on the tape width detected by the tape width detecting device; and a print control device for retrieving from the storage device the test pattern data corresponding to the detected tape width upon operation of the appropriate key, and for causing the printer to print onto the tape the test pattern based on the retrieved test pattern data.

In operation, the tape printing apparatus waits for the appropriate key to be operated. The key operation causes the print control device to retrieve from the storage device the test pattern data corresponding to the tape width detected by the tape width detecting device. The printer then prints onto the tape the test pattern corresponding to the retrieved test pattern data.

Other objects, features and advantages of the present invention will become apparent in the following detailed description and accompanying drawings.

BRIEF DESCRIPTION OF THE DRAWINGS

A preferred embodiment of the present invention will be described in detail with reference to the figures, wherein.

DETAILED DESCRIPTION OF PREFERRED EMBODIMENTS

Figure 1:
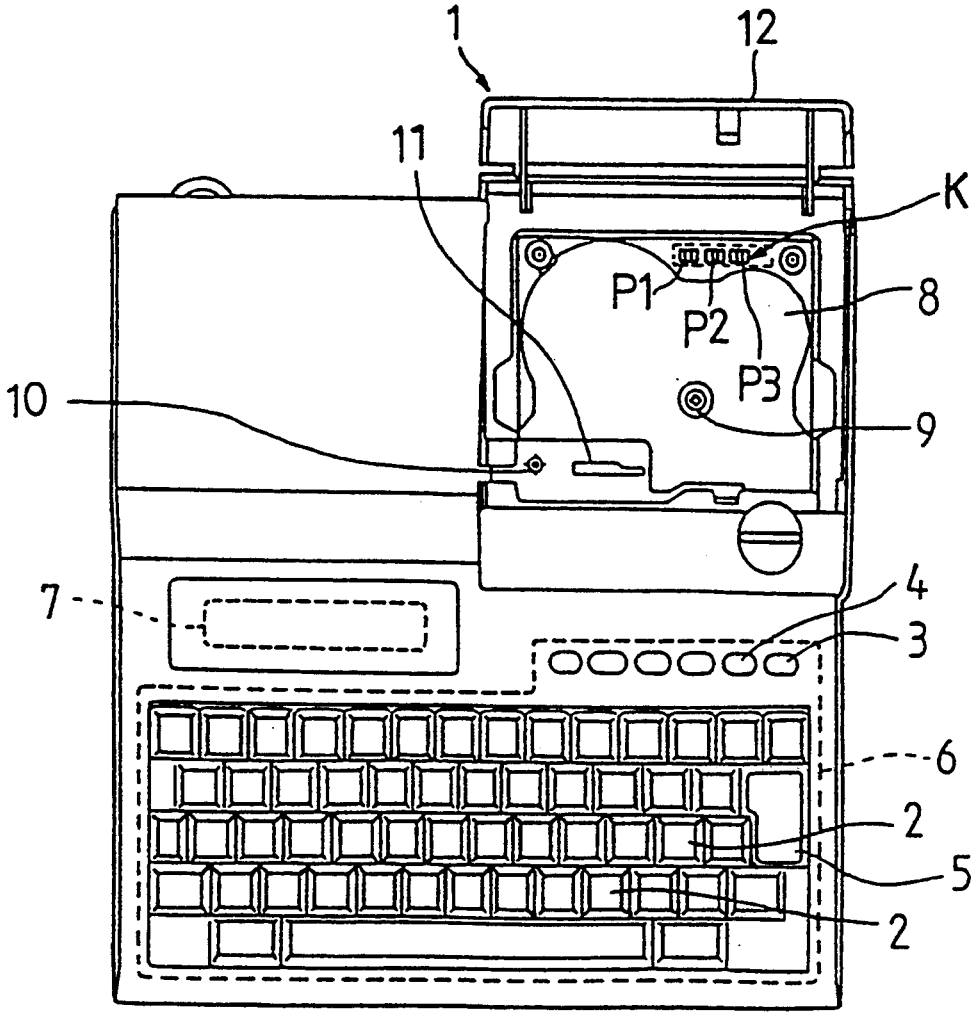
FIG. 1 is a plan view of a tape printing apparatus according to the invention, with the cover of a tape cassette accommodating part of the apparatus opened.

A preferred embodiment of the invention will now be described with reference to the accompanying drawings. FIG. 1 is a plan view of the tape printing apparatus in the embodiment according to the invention. The cover of the tape cassette accommodating part is shown opened. In FIG. 1, the tape printing apparatus 1 comprises a keyboard 6 including character input keys 2, a print key 3, a test print key 4 and a return key 5; a liquid-crystal display 7; and the tape cassette accommodating part 8. The character input keys 2 are used to input a plurality of lines of characters and other symbols so as to create a plurality of text files that are made of text data. The print key 3 designates the printing of each file when operated. The test print key 4 is used to carry out test printing. The return key 5 is operated to feed lines or to designate the execution of various processes. The LCD 7 displays the characters and other symbols that are input from the keyboard 6. The tape cassette accommodating part 8 accommodates a tape cassette 13, to be described later.

The tape cassette accommodating part 8 has a ribbon take-up shaft 9 positioned therein. Driven by a pulse motor, not shown, the ribbon take-up shaft 9 rotates a ribbon take-up spool 21 to take up a thermal ink ribbon 17. Obliquely to the front (on the side of the keyboard 6) is a tape feed roller shaft 10 driven by a tape feed motor 40, to be described later, via appropriate means. The tape feed roller shaft 10 rotates a tape feed roller 27, also to be described later. To the front of the tape cassette accommodating part 8 is fixed a thermal head 11. The thermal head 11 effects printing onto a film tape 15, to be discussed later, through the thermal ink ribbon 17. The thermal head 11 constitutes the printing means of this invention.

To the rear of the tape cassette accommodating part 8 is a tape width detector K for detecting the width of the tape (e.g., film tape 15) contained in the tape cassette 13. One tape cassette contains a tape of the same width over its entire length.

The tape width detector K is made of three photocouplers P1, P2 and P3. When the tape cassette 13 is set in the tape cassette accommodating part 8, discriminators H protruding from the base of the cassette enter and shut off the photo-couplers P1, P2 and P3 selectively. The selective shutting off of the photo-couplers allows the tape width detector K to detect the width of the tape contained in the tape cassette 13.

The tape width detector K constitutes the tape width detecting means of this invention. This tape width detector K has the same structure as that disclosed in Japanese Patent Application No. Hei 3-217860 and will not be discussed further.

The tape cassette accommodating part 8 has a cover 12 pivotably attached to the rear of the tape printing apparatus 1. When opened, the cover 12 permits access to the tape cassette so that the tape cassette 13 may be replaced as needed.

Figure 2:
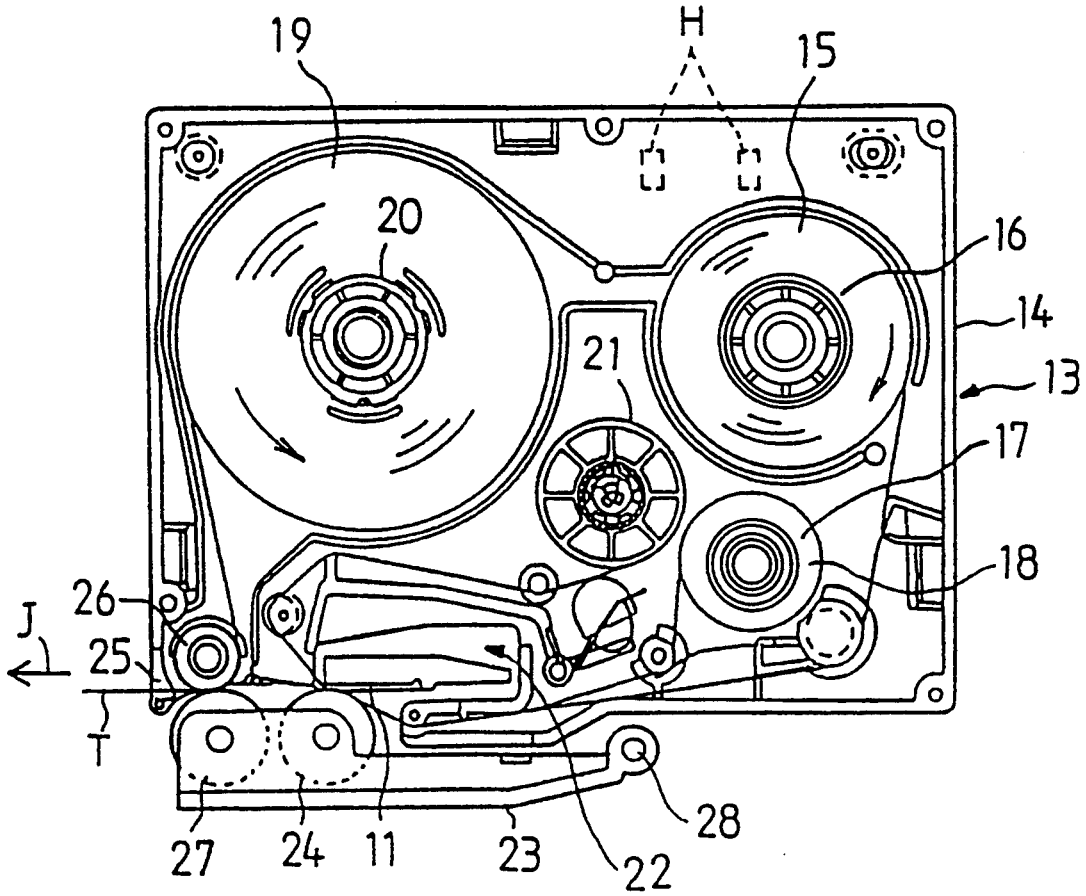
FIG. 2 is a plan view showing how a tape cassette is accommodated in the tape cassette accommodating part.

The construction of the tape cassette 13 will now be described with reference to FIG. 2. FIG. 2 is a plan view showing the tape cassette 13 accommodated in the tape cassette accommodating part 8.

In FIG. 2, a lower case 14 of the tape cassette 13 incorporates a tape spool 16 around which a transparent film tape 15 is wound, a ribbon spool 18 around which the thermal ink ribbon 17 is wound, and an adhesive tape spool 20 around which is wound a strip paper-covered adhesive double-coated tape with its strip paper side facing outward. The spools 16, 18 and 20 are rotatably supported by cooperative support members that are attached to the bottom of the upper case (not shown).

Between the spools 16, 18 and 20 is the ribbon take-up spool 21, which is rotatably supported and engaged with the ribbon take-up shaft 9. When driven by the ribbon take-up shaft 9, the ribbon take-up spool 21 takes up the thermal ink ribbon 17 after printing.

The thermal head 11 is positioned in a concave portion 22 of the lower case 14. Opposite the thermal head 11 is a platen roller 24 rotatably supported by a roller holder 23. The platen roller 24 is so positioned as to be pressed against the thermal head 11. The thermal head 11 has numerous heating elements (there are preferably about 128 heating elements on the thermal head 11 of this embodiment). The heating elements when heated print characters and other symbols onto the film tape 15 through the thermal ink ribbon 17.

Near a tape ejecting part 25 (bottom left in FIGS. 1 and 2) of the lower case 14 is a tape pressure contact roller 26 rotatably supported opposite the tape feed roller 27. The tape pressure contact roller 26 is positioned to be pressed against the tape feed roller 27 supported rotatably by the roller holder 23.

To the front of the tape cassette 13 (bottom in FIGS. 1 and 2) in the tape cassette accommodating part 8 is the roller holder 23 pivotably supported by a support shaft 28. A manual switching mechanism, not shown, allows the roller holder 23 to be set either to the print position or to the release position. (FIGS. 1 and 2 both show the roller holder 23 in its print position.)

The roller holder 23 rotatably supports the platen roller 24 and tape feed roller 27. When set to its print position, the roller holder 23 presses the platen roller 24 against the thermal head 11 and the tape feed roller 27 against the pressure contact roller. The pressure contact roller 26 and tape feed roller 27 are driven in cooperation by a gear mechanism (not shown).

The pressure contact roller 26 and tape feed roller 27 rotate in cooperation so as to press the adhesive double-coated tape 19 against the film tape 15 bearing printed characters and other symbols. The eventually produced tape T is fed in the direction of arrow J (FIG. 2). The tape T is cut to size by a cutter (not shown) located on the left-hand side of the tape cassette 13. The construction of the cutter is known and will not be discussed further.

Figure 3:
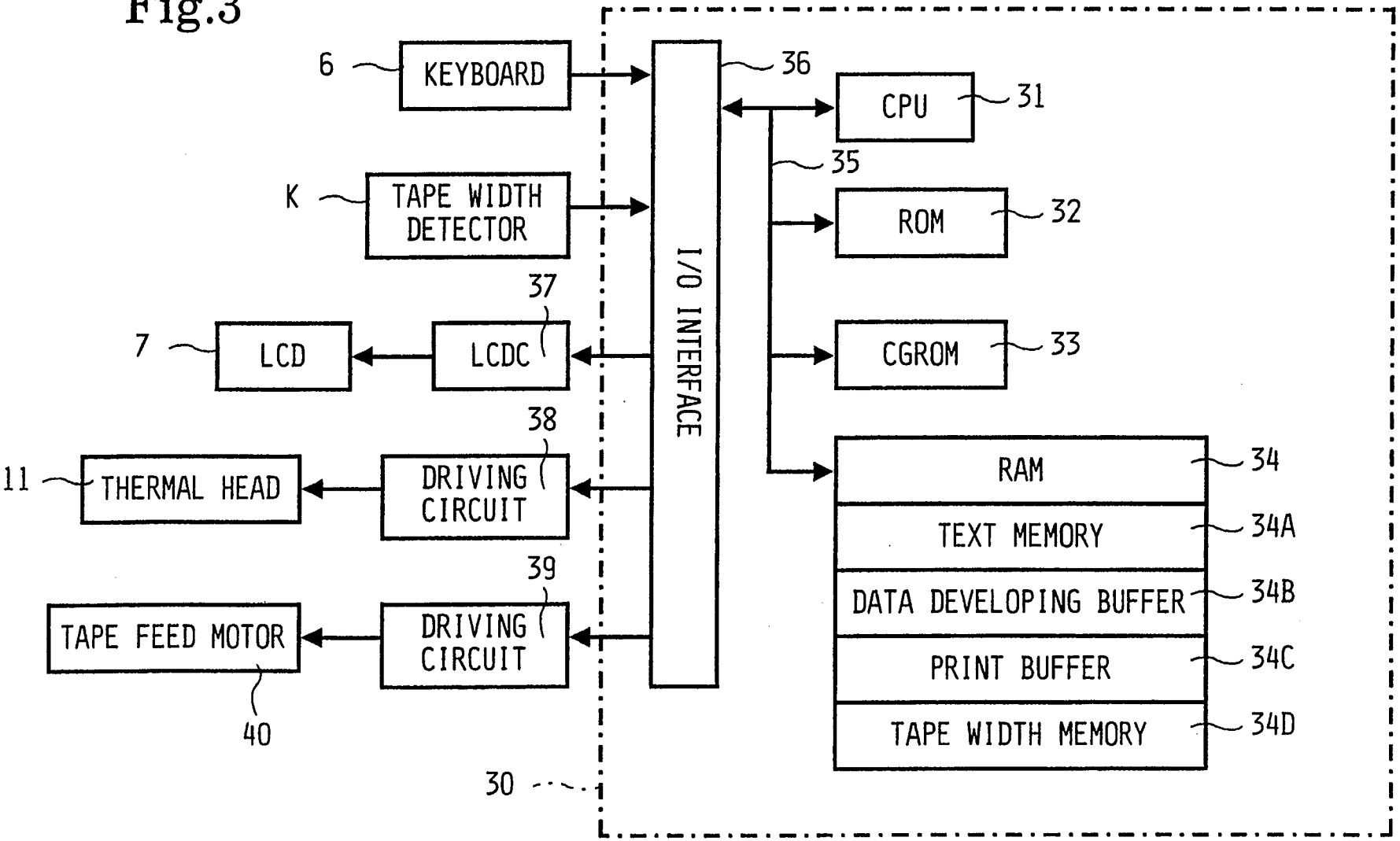
FIG. 3 is a control block diagram.

The control of the tape printing apparatus 1 will now be described with reference to FIG. 3. FIG. 3 is a control block diagram of the tape printing apparatus 1. A control unit 30 plays a dominant role in the operation of the apparatus, comprising a CPU 31, a ROM 32, a CGROM 33 and a RAM 34. These parts are interconnected through a bus 35 and are connected to an I/O interface 36.

The ROM 32 contains various programs needed to control the tape printing apparatus 1. These programs include a text editing control program, a text print control program, test print control program and other programs. The CPU 31 performs various operations based on the programs stored in the ROM 32.

Figure 4:
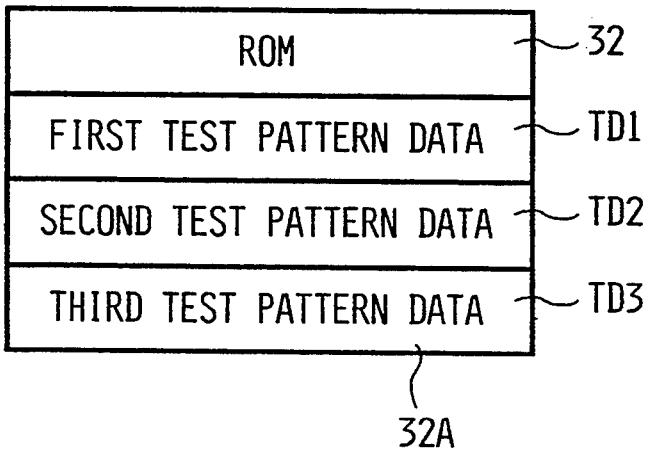
FIG. 4 is a schematic view of the contents of the ROM.

As shown in FIG. 4, the ROM 32 has a test pattern data storage area 32A, storing three kinds of test pattern data TD1, TD2 and TD3. The first test pattern data TD1 is used to print a test pattern onto tape 6 mm or 9 mm wide; the second test pattern data TD2 is used to print a test pattern onto tape 12 mm or 18 mm wide; the third test pattern data TD3 is used to print a test pattern onto tape 24 mm wide. The test pattern data storage area 32A of the ROM 32 constitutes the storage means of this invention.

The CGROM 33 stores the dot pattern data and outline font data corresponding to the characters that may be entered from the keyboard 6. The dot pattern data is used to display the entered characters while the outline font data is used to define the outlines of the printed characters. In conjunction with the character code of each character entered, the corresponding dot pattern data is read from the CGROM 33 and displayed on the LCD 7. For printing of each character, the corresponding outline font data is read from the CGROM 33 and developed into dot pattern data in a data developing buffer 34B, to be described later.

The RAM 34 temporarily accommodates the results of various operations carried out by the CPU 31. The RAM 34 has various memory regions as illustrated in FIG. 3.

In FIG. 3, a text memory 34A consecutively stores, as text data, the code data corresponding to the characters entered from the keyboard 6. The data developing buffer 34B allows outline font data to be developed in its pattern region into dot pattern data about each character, the outline font data being read from the CGROM 33 in conjunction with the character code data stored in the text memory 34A. A print buffer 34C receives and stores the dot pattern data transferred from the data developing buffer 34B at the time of printing. The thermal head 11 prints characters using the dot pattern data stored in the print buffer 34C. A tape width memory 34D stores the data about the width of the tape detected by the tape width detector K.

Referring again to FIG. 3 for the description of the control block diagram, the keyboard 6, the LCD 7 and a display controller 37 are connected to the control unit 30 via the I/O interface 36. When characters are input from the keyboard 6, the corresponding character data is stored consecutively in the text memory 34A. At the same time, a dot pattern generation control program and a display control program allow the dot patterns corresponding to the entered characters to be displayed on the LCD 7.

The thermal head 11, driven by a driving circuit 38, prints the dot pattern data transferred from the data developing buffer 34B to the print buffer 34C. In synchronism with printing, the tape feed motor 40 feeds the tape T by means of a driving circuit 39.

The operation of the tape printing apparatus 1 will now be described with reference to FIGS. 5 through 8.

Figure 5:
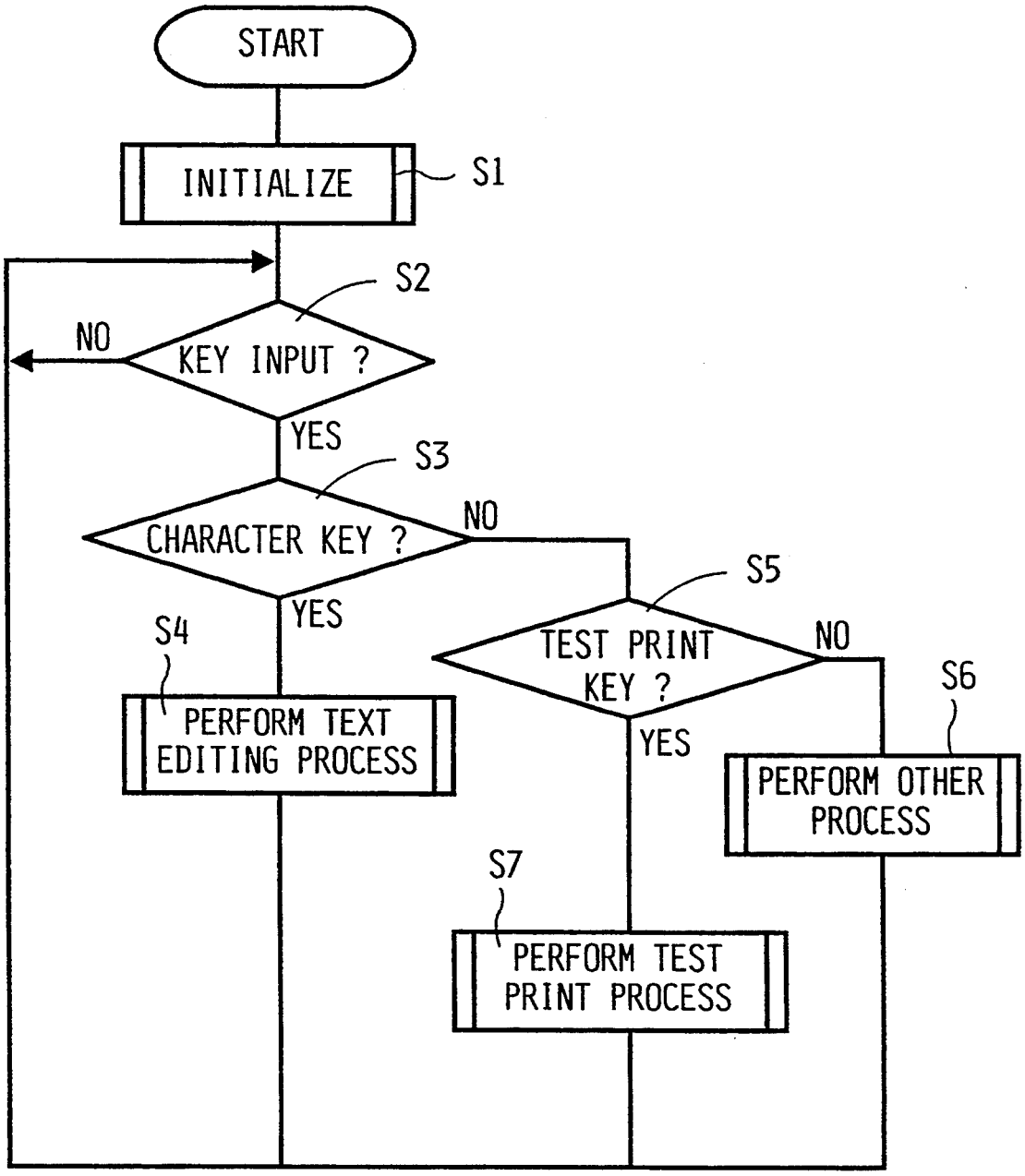
FIG. 5 is a flowchart of steps showing a test editing control program.

FIG. 5 is a flowchart of steps in the test editing control program. In step 1, the memory regions in the RAM 34 are initialized. A check is made to see if any key input is made from the keyboard 6 (step 2). If no key input is detected (NO in step 2), the tape printing apparatus waits for any key to be operated (step 2). If any key input is detected (YES in step 2), a check is made to see if the key input is from any one of the character input keys 2 (step 3). If the key input comes from the character input keys 2 (YES in step 3), a text editing process is carried out in which the character code corresponding to the operated key is stored into the text memory 34A, and the operation returns to step 2.

Figure 6:
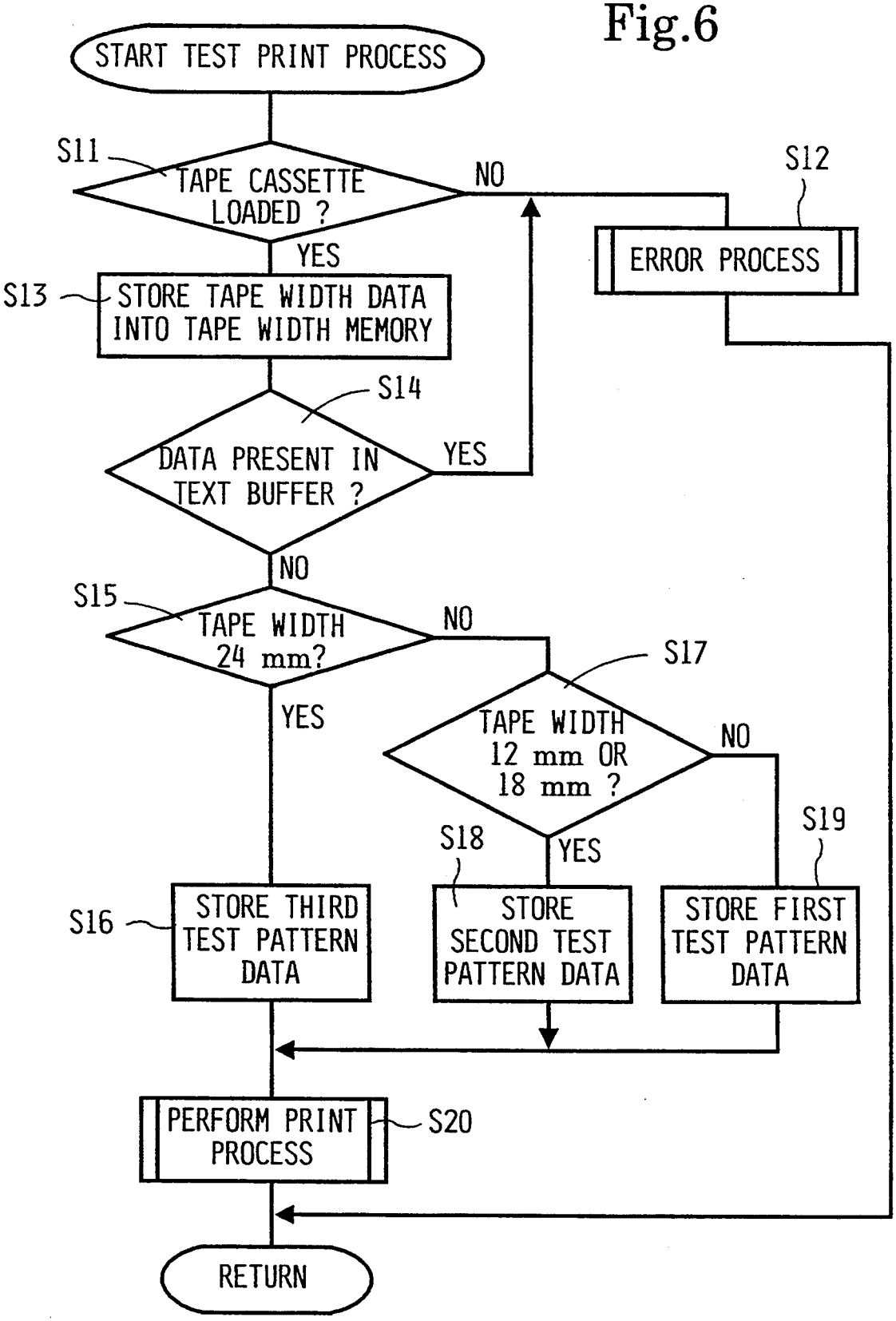
FIG. 6 is a flowchart of steps in which test printing is carried out.

If the key input does not stem from any of the character input keys 2 (NO in step 3), a check is made to see if the key input comes from the test print key 4 (step 5). If the key input does not come from the test print key 4 (NO in step 5), the process that corresponds to the actually operated key is carried out (step 6). If the key input comes from the test print key (YES in step 5), the test print process of FIG. 6 is carried out (step 7).

After the test print process has been initiated (FIG. 6), a check is made to see if the tape cassette 13 is set in the tape cassette accommodating part 8 of the tape printing apparatus 1 (step 11). The judgment is made on the basis of an H/L signal combination generated by the photo-couplers P1, P2 and P3 of the tape width detector K. If the tape cassette 13 is not set (NO in step 11), an error indication process is carried out in which a buzzer (not shown) is activated, and the LCD 7 displays a message saying that test printing cannot be executed (step 12). With the error indication process terminated, the operation returns to step 2 of FIG. 5.

If the tape cassette 13 is found to be set (YES in step 11), the width of the tape inside the tape cassette 13 loaded in the tape cassette accommodating part 8 is detected, and the tape width data is stored into the tape width memory 34D (step 13). The tape width is detected by use of the signals coming from the tape width detector K.

A check is then made to see if there is any text data in the text memory 34A (step 14). If text data is found in the text memory 34A (YES in step 14), an error indication process is carried out (step 12), and the operation returns to step 2 of FIG. 5. If no text data is found in the text memory 34A (NO in step 14), another check is made to see if the width of the tape in the tape cassette 13 is 24 mm (step 15). If the tape width is indeed 24 mm (YES in step 15), the third test pattern data TD3 is placed into the text buffer 34A following retrieval from the test pattern data storage area 32A in the ROM 32 (step 16). A print process is then executed using the third test pattern data TD3 held in the text buffer 34A (step 20).

In the print process, character codes are read consecutively from the text buffer 34A. The outline font data corresponding to the retrieved character codes is read from the CGROM 33. The outline font data is developed into dot pattern data in the data developing buffer 34B. The developed dot pattern data is stored into the print buffer 34C. The heating elements of the thermal head 11 are activated in accordance with the dot pattern data in the print buffer 34C. Concurrently, the tape feed motor 40 is driven to print the characters in dots onto the film tape 15.

FIG. 7(C) shows typical results of the above print process. The test pattern illustrated in FIG. 7(C) allows the user to verify that up to 7 lines of characters may be printed on the 24 mm-wide tape by the tape printing apparatus 1. Also verified are the maximum size of the characters that may be printed on the 24 mm-wide tape, the types of alphabetic character fonts that may be printed, and the character ornamentations available.

If the tape width memory 34D stores data indicating 12 mm or 18 mm as the tape width (NO in step 15; YES in step 17), the second test pattern data TD2 is read from the test pattern data storage area 32A and stored into the text buffer 34A (step 18). The print process is then carried out using the second test pattern data TD2 (step 20).

Figure 7:
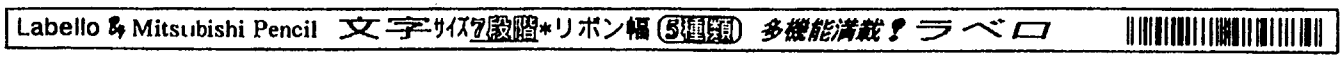
FIGS. 7(A), 7(B) and 7(C) show typical results of the test printing.
Figure 7:
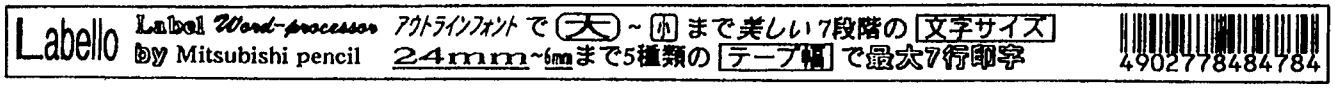
Figure 7:
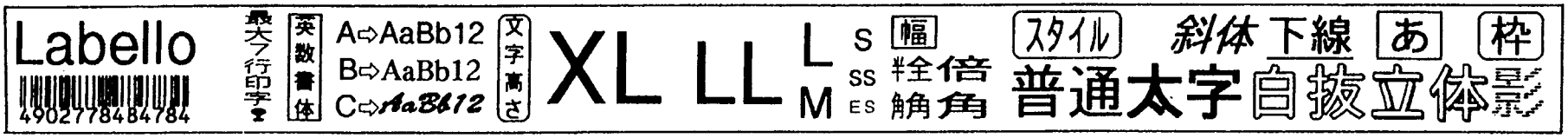

FIG. 7 (B) shows the test pattern printed on the 12 mm-wide tape in the above print process based on the second test pattern data TD2. The test pattern given in FIG. 7 (B) allows the user to verify that up to 2 lines of characters may be printed on the 12 mm-wide tape by the tape printing apparatus 1. Also verified is the maximum size of the characters that may be printed on the tape 12 mm wide. Furthermore, the printable types of alphabetic character fonts and the available character ornamentations are verified in the same manner as with the 24 mm-wide tape. Meanwhile, one feature of the tape printing apparatus 1 is its ability to print bar codes. Where bar codes are printed on the tape 24 mm wide, they can be seen to be printed together with their accompanying numeric data underneath. Where bar codes are printed on the 12 or 18 mm-wide tape, they can be seen to be printed together with their accompanying numeric data underneath, as in the case of the 24 mm-wide tape.

The same test pattern printed on the 12 mm-wide tape is also printed on the 18 mm-wide tape (not shown).

If the tape width data in the tape width memory 34D represents 6 mm or 9 mm (NO in steps 15 and 17), the first test pattern data TD1 is read from the test pattern data area 32A and stored into the text buffer 34A (step 19). The print process is then carried out using the first test pattern data TD1 (step 20).

FIG. 7(A) shows the test pattern printed on the 6 mm-wide tape in the above print process based on the first test pattern data TD1. The test pattern given in FIG. 7(A) allows the user to verify that only one line of characters can be printed on the 6 mm-wide tape by the tape printing apparatus 1. Also verified is the maximum size of the characters that may be printed on the 6 mm-wide tape. Furthermore, the printable types of alphabetic character fonts and the available character ornamentations are verified in the same manner as with the 24 mm-wide tape. It can be seen that if bar codes are printed on the 6 mm-wide tape, they cannot be printed together with their accompanying numeric data underneath.

When all data in the text memory 34A has been printed in step 20, the test print process comes to an end. With the printing completed, the operation returns to step 2 of FIG. 5.

The control unit 30 executing steps 15 through 20 constitutes the print control means of this invention.

As described, the tape printing apparatus 1 according to the invention starts printing when the test print key 4 is operated. If the tape cassette 13 is set in the tape cassette accommodating part 8 and if the text memory 34A contains no data, test pattern data is read from the test pattern data storage area 32A corresponding to the width of the tape in the tape cassette 13. The test pattern is then printed on the tape using the retrieved test pattern data. As a result, the user need not be aware of the width or the type of the tape in the tape cassette 13.

Viewing the printed test pattern allows the user to easily verify the maximum number of character lines that may be printed on the tape of the currently loaded tape cassette 13, the maximum allowable character size for the tape, the printable alphabetic character fonts, the available character ornamentations, and the availability of printing numeric data underneath each bar code. Because the tape printing apparatus is capable of printing the test pattern according to the width of the currently loaded tape, it is readily understood what sort of printing is available for that particular tape.

Although the description above contains many specificities, these should not be construed as limiting the scope of the invention but as merely providing illustrations of the preferred embodiment according to this invention. For example, although in the above embodiment, one kind of test pattern based on the first test pattern data TD1 is printed onto the 6 mm- and 9 mm-wide tapes, and another kind of test pattern based on the second test pattern data TD2 is printed onto the 12 mm- and 18 mm-wide tapes, the test pattern based on the first or second test pattern data TD1 or TD2 may be printed onto the 9 or 18 mm-wide tape after being adjusted in size to the currently loaded tape.

The above embodiment has the data on three different test patterns stored in the ROM 32 for printing onto tapes of five different widths. Alternatively, the ROM may store data about five different test patterns corresponding respectively to the tapes of the five different widths.

In addition, although in the above embodiment there is provided the dedicated test print key 4 for executing test printing, the test print process may alternatively be performed by operating a combination of other keys.

Thus, the scope of the invention should be determined by the appended claims and their legal equivalents, rather than by the examples given.

What is claimed is:

1. A tape printing apparatus including a test printing function for printing a predetermined test pattern onto a tape having a tape width, the tape printing apparatus comprising:

printing means for printing said predetermined test pattern;

tape width detecting means for detecting said tape width;

storage means for storing pre-established test pattern data of a plurality of different test patterns, said test pattern data of said plurality of different test patterns including all printable character sizes and printable number of lines for a plurality of different tape widths; and print control means for retrieving from said storage means respective test pattern data corresponding to said tape width detected by said tape width detecting means, and for causing said printing means to print said respective test pattern data onto said tape.

2. The tape printing apparatus as claimed in claim 1, wherein said storage means includes means for storing first test pattern data corresponding to at least a first tape width, second test pattern data corresponding to at least a second tape width, and third test pattern data corresponding to at least a third tape width.

3. The tape printing apparatus as claimed in claim 2, wherein said first tape width comprises 24 mm, said second tape width comprises 12 mm and 18 mm, and said third tape width comprises 6 mm and 9 mm.

4. The tape printing apparatus as claimed in claim 1, further comprising means for initiating said test printing function.

5. The tape printing apparatus as claimed in claim 4, wherein said means for initiating said test printing function comprises a test print key.

6. The tape printing apparatus as claimed in claim 1, further comprising:

a tape cassette accommodating section for accommodating a tape cassette;

means for determining whether a tape cassette is set in said tape cassette accommodating part; and means for providing an error signal if said tape cassette is not set in said tape cassette accommodating part.

7. The tape printing apparatus as claimed in claim 1, further comprising temporary storage means for storing said tape width detected by said tape width detecting means.

8. The tape printing apparatus according to claim 1, wherein said storage means includes means for storing at least two test patterns including a first test pattern data corresponding to at least a first tape width and a second test pattern data corresponding to at least a second tape width.

9. The tape printing apparatus according to claim 1, wherein said storage means includes means for storing at least three test patterns including a first test pattern data corresponding to at least a first tape width, a second test pattern data corresponding to at least a second tape width and a third test pattern data corresponding to at least a third tape width.

10. A tape printing method for a tape printing apparatus including a test printing function for printing a predetermined test pattern onto a tape having a tape width, the method comprising the steps of:

storing pre-established test pattern data of a plurality of different test patterns, said test pattern data of said plurality of different test patterns including all printable character sizes and printable number of lines for a plurality of different tape widths;

detecting said tape width;

retrieving respective test pattern data corresponding to said tape width detected in said detecting step; and printing said respective test pattern data onto said tape.

11. The method as claimed in claim 10, wherein said storing step comprises the step of storing first test pattern data corresponding to at least a first tape width, second test pattern data corresponding to at least a second tape width, and third test pattern data corresponding to at least a third tape width.

12. The method as claimed in claim 10, further comprising the step of initiating said test printing function.

13. The method as claimed in claim 12, wherein said initiating step comprises the step of manipulating a test print key.

14. The method as claimed in claim 10, further comprising the steps of:

determining whether a tape cassette is set in a tape cassette accommodating part of said tape printing apparatus; and providing an error signal if said tape cassette is not set in said tape cassette accommodating part.

15. The method as claimed in claim 10, further comprising the step of temporarily storing said tape width detected in said detecting step.

16. The method according to claim 10, wherein said storing step comprises the step of storing at least two test patterns including a first test pattern data corresponding to at least a first tape width and a second test pattern data corresponding to at least a second tape width.

17. The method according to claim 10, wherein said storing step comprises the step of storing at least three test patterns including a first test pattern data corresponding to at least a first tape width, a second test pattern data corresponding to at least a second tape width and a third test pattern data corresponding to at least a third tape width.

18. A tape printing apparatus including a test printing function for printing a predetermined test pattern onto a tape having a tape width, the tape printing apparatus comprising:

a printer for printing said predetermined test pattern;

a tape width detector for detecting said tape width;

a ROM for storing pre-established test pattern data of a plurality of different test patterns, said test pattern data of said plurality of different test patterns including all printable character sizes and printable number of lines for a plurality of different tape widths; and a print control unit for retrieving from said ROM respective test pattern data corresponding to said tape width detected by said tape width detector, and for causing said printer to print said respective test pattern data onto said tape.

19. The tape printing apparatus as claimed in claim 18, further comprising a keyboard, a liquid crystal display, and a tape feed motor, said print control unit communicating with said keyboard, tape width detector, liquid crystal display, printer, and tape feed motor via an input/output interface, said print control unit comprising said input/output interface, a CPU, said ROM, and a RAM for storing said tape width detected by said tape width detector.

20. The tape printing apparatus according to claim 18, wherein said ROM provides means for storing at least three test patterns including a first test pattern data corresponding to at least a first tape width, a second test pattern data corresponding to at least a second tape width and a third test pattern data corresponding to at least a third tape width.

21. The tape printing apparatus according to claim 18, wherein said ROM provides means for storing at least two test patterns including a first test pattern data corresponding to at least a first tape width and a second test pattern data corresponding to at least a second tape width.

* * * * *

UNITED STATES PATENT AND TRADEMARK OFFICE

CERTIFICATE OF CORRECTION

PATENT NO. : 5,447,378

DATED : September 5, 1995

INVENTOR(S) : Satomi Otsuka, Akihiro Sawada, Sachiyo Nagase

It is certified that error appears in the above-indentified patent and that said Letters Patent is hereby corrected as shown below:

On title page, item [75]

change the name of inventor "Sachiro Nagase" to --Sachiyo Nagase--.

Signed and Sealed this

Seventh Day of November, 1995

*Attest:*

Bruce Lehman

BRUCE LEHMAN

*Attesting Officer*

*Commissioner of Patents and Trademarks*